United States Patent [19]

El-Hamamsy

[11] Patent Number: 4,902,942

[45] Date of Patent: Feb. 20, 1990

[54] CONTROLLED LEAKAGE TRANSFORMER FOR FLUORESCENT LAMP BALLAST INCLUDING INTEGRAL BALLASTING INDUCTOR

[75] Inventor: Sayed-Amr El-Hamamsy, Schenectady, N.Y.

[73] Assignee: General Electric Company, Schenectady, N.Y.

[21] Appl. No.: 200,881

[22] Filed: Jun. 2, 1988

[51] Int. Cl.[4] ..... H05B 41/16; H01F 27/28

[52] U.S. Cl. ..... 315/276; 315/278; 336/182

[58] Field of Search ..... 315/95, 276, 278; 336/182

[56] References Cited

U.S. PATENT DOCUMENTS 3,919,595 11/1975 Willis, Jr. ..... 315/278 X
4,672,528 6/1987 Park et al. ..... 363/98

OTHER PUBLICATIONS

A. Dauhajre, "Modeling and Estimating of Leakage Phenomena in Magnetic Circuits", PhD. Thesis, California Inst. of Tech., 1986.

J. J. Spangler, "A Power Factor Correction MOSFET, Multiple Output, Flyback Switching Supply", Proc. of the 10th International PCI, Chicago, Ill. 1985, pp. 19–32.

*Primary Examiner*—David Mis

*Attorney, Agent, or Firm*—Marvin Snyder; James C. Davis, Jr.

[57] ABSTRACT

All the magnetic functions required in a ballast for a fluorescent lamp are integrated in a single, standard magnetic core which provides isolation, voltage step-up, ballasting, power factor correction and cathode heat for multiple lamps operating multiple lamps in an isolated-series configuration. In a three-legged transformer core embodiment, the primary winding is continuously wound on all three legs, while secondary windings are included on two of the legs. Ballasting inductance is provided by winding the primary on the third leg. The number of primary turns $N_p$ necessary to avoid saturation of the transformer for any specific input voltage and core material, the number of primary windings $N_{p1}$ on the secondary legs and the number of primary windings $N_{p2}$ on the third leg are determined according to the equation $2N_{p1}=N_p-N_{p2}$.

8 Claims, 7 Drawing Sheets

Fig. 2
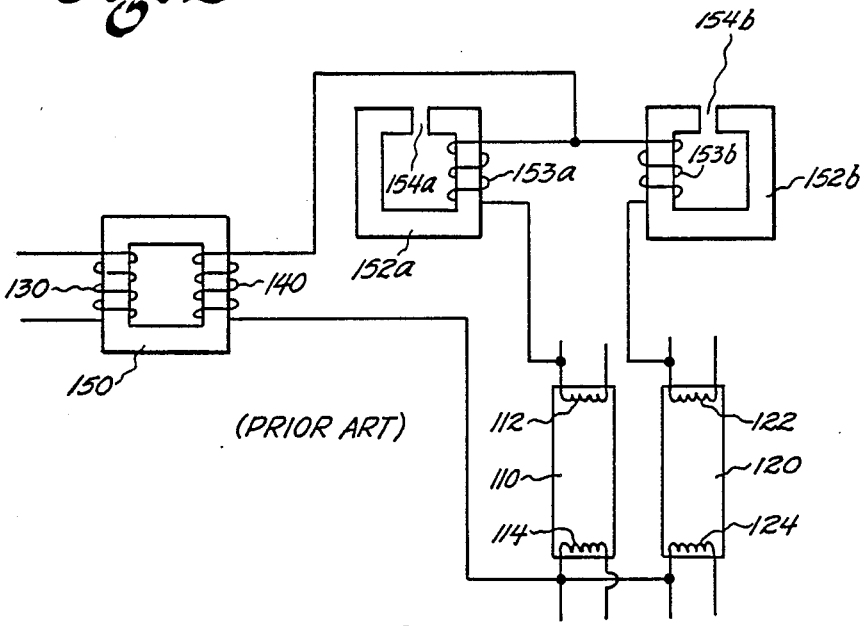
(PRIOR ART)
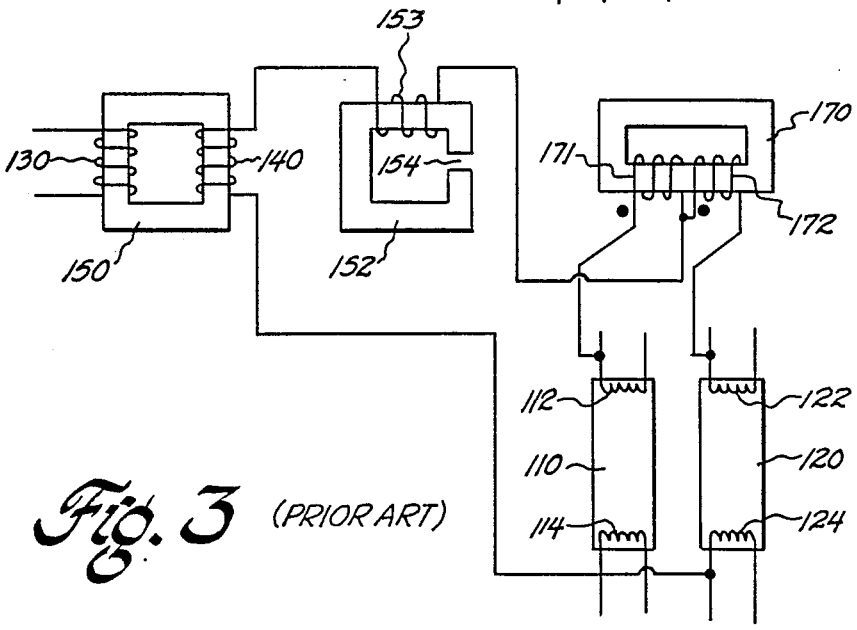
Fig. 3 (PRIOR ART)

CONTROLLED LEAKAGE TRANSFORMER FOR FLUORESCENT LAMP BALLAST INCLUDING INTEGRAL BALLASTING INDUCTOR

BACKGROUND OF THE INVENTION

This invention relates to gas discharge lamp ballast circuits and, more particularly, to ballast circuits for driving a plurality of gas discharge lamps.

A gas discharge lamp is an electrical device which exhibits certain special electrical characteristics. In particular, gas discharge lamps exhibit a negative impedance characteristic—once the arc of a gas discharge lamp has been struck, the current through the discharge medium increases while the voltage drop between the lamp electrodes decreases. Therefore, it is necessary to provide means for limiting the current as an element of the ballast circuit. If current-limiting means are not provided, lamp failure or transformer burnout generally results.

Because of the negative impedance characteristic, parallel operation of gas discharge lamps is generally precluded even though it provides certain desirable features. When parallel operation of gas discharge lamps is attempted, the arc in one lamp is generally struck first, resulting in a voltage drop across the parallel combination. Therefore, the first lamp struck eventually carries all of the current supplied to the parallel lamp combination, resulting in only one lamp of the parallel-connected set being started and all the rest staying dark. Obviously, such a mode of operation is not tolerable. Accordingly, series operation of gas discharge lamps has been seen as a more desirable mode of operation. However, series operation of gas discharge lamps operated at high frequency (20 kilohertz and above) may result in capacitive coupling between the lamps and surrounding ground planes. This capacitive coupling results in substantial leakage currents through the lamp's glass envelope. This phenomenon is more pronounced in series-connected lamps because the large voltage drops which occur along the lamp string create a significant potential difference between the lamps and ground.

Another disadvantage of the high voltages necessary for series operation of gas discharge lamps is the hazard posed by the voltage required to turn on all the lamps. When one of the lamps is removed from its socket the voltage at the upper socket will equal the start up voltage across the lamp string since removal of the lamp interrupts the current flow. Therefore, removal of a single lamp in a series chain results in the appearance of hazardous voltage at the lamp socket. In order to avoid the high voltage in series-connected lamp circuits it is at times necessary to employ complex, and expensive, control schemes. In a parallel connected configuration, the maximum voltage which will appear at the lamp socket is the voltage required to turn on one lamp, which is ordinarily not enough to present problems. Therefore, parallel operation would normally be preferred if a way could be found to overcome the start up problems discussed previously. This problem may be corrected by using an "isolated-series" configuration (see FIG. 6) for connecting the discharge lamps to the transformer. Such a configuration will be described in greater detail hereinafter.

The principal concern of this application is the design of an improved "isolated-series" ballast circuit for powering gas discharge lamps. It is recognized that some ballast circuit designs also incorporate a means for lamp starting. However, the discussion herein generally relates to the problem of driving lamps which have already been started. Therefore, means for starting the lamps will not be illustrated or described in detail in this application as it is assumed that one of ordinary skill in the art will be well acquainted with such means.

As described above, it is necessary to provide a current-limiting means for gas discharge lamp ballast circuits. Since resistive current limiting would degrade the operating efficiency of the ballast circuit, the current-limiting means typically comprises some form of inductance. The reactance of the inductor limits the flow of current through series-connected lamps. In addition, the typical electronic ballast circuit for gas discharge lamps also includes a transformer to step up the input voltage and isolate the voltage source from the lamps.

In view of the problems associated with both series and parallel operation of multi-lamp circuits, several arrangements have been proposed to combine the advantages of parallel operation with the startup advantages of series operation while minimizing their respective disadvantages. Most of the suggested arrangements have involved the use of complex magnetic circuits which include multiple external inductors. Several of these circuits are mentioned briefly hereinbelow and described more fully with respect to the detailed description of our invention.

One suggested gas discharge lamp ballast circuit, illustrated in FIG. 2, employs an isolation transformer with a single secondary winding. The discharge lamps are connected essentially in parallel across the secondary winding of the isolation transformer through two separate, uncoupled inductors. Each inductor separately limits current in the lamp to which it is connected. This configuration reduces leakage current but has the disadvantage of increasing the volt-ampere requirements of the ballast circuit to compensate for the inductor losses. Further, in this configuration each lamp requires a separate ballast inductor which adds to the size and cost of the ballast circuit.

Another proposed gas discharge lamp ballast circuit, illustrated in FIG. 3, also employs a transformer with a single secondary winding. The lamps are connected to one side of the secondary winding through a current-limiting inductor and a "current-sharing inductor". The smaller current-sharing inductor is designed to balance the current through the two lamps. However, the current-sharing inductor only tolerates small lamp-to-lamp voltage differences without saturation. Furthermore, although the current-sharing coil is smaller than the current-limiting inductor it replaces, it still contributes substantially to the size, weight and cost of the circuit. In addition, the circuit of FIG. 3 also requires more total volt-amperes than conventional series lamp operation to overcome losses in the inductor and the current-sharing coil. Finally, it would be difficult to extend this current-sharing coil concept to more than two lamps.

A third solution to the gas discharge lamp ballast circuit problem which is particuarly relevant to this invention utilizes a transformer connected in "isolated-series" configuration. Such a transformer is illustrated in FIG. 4. An isolated-series ballast circuit for driving a plurality of gas discharge lamps comprises a multi-legged transformer core with at least three legs. A primary winding and at least two secondary windings are disposed on separate transformer legs. Gas discharge lamps are connected across each of the secondary windings. In addition, isolated-series connected transformers preferably include means, such as secondary taps, to heat the gas discharge lamp filament electrodes. The isolated-series ballast circuit is readily extendable to circuits in which three, four or more gas discharge lamps are driven simultaneously by providing an additional transformer leg and corresponding secondary winding for each additional lamp. Because of the magnetic characteristics of the circuit described more fully hereinbelow, isolated-series operation achieves substantially all of the advantages of both series and parallel operation with few of their respective disadvantages. Isolated-series operation is therefore a desirable method of driving multiple gas discharge lamps.

The design of isolated-series ballast circuits is complicated by a number of factors. First, ballast transformers normally step up the input signal to provide sufficient voltage at the secondary to drive the gas discharge lamp. In order to achieve the maximum efficiency in such a step-up transformer, it is desirable to minimize the number of windings in both the secondary and the primary to reduce the winding losses. However, if the number of primary windings is too small, the transformer core will saturate, limiting the output voltage of the secondary, and the core losses will increase. Therefore, it is necessary to include sufficient primary turns to avoid saturating the transformer within the desired range of input voltages.

A second factor complicating the design of "isolated-series" and other, more conventional ballasts, is the inherent leakage inductance of the transformer. Physical transformers are normally modeled as ideal transformers with parallel magnetizing and series leakage inductances. Because of the difficulties encountered in attempting to quantize leakage inductance in conventional ballast transformers, it has been desirable to limit the effect of the leakage inductance by coupling the primary and secondary together as closely as possible. The closest possible coupling occurs when the primary and secondary are wound on the same core leg. However, winding the primary and secondary on the same core leg presents significant manufacturing and electrical drawbacks in circuits where more than one secondary is necessary. Mechanically, it is extremely difficult to wind multiple secondaries on the same leg as the primary. Electrically, the amount of leakage flux increases with every additional winding separating a particular secondary from the primary, resulting in unpredictable and unbalanced secondary voltages.

Finally, as will be readily apparent from the description hereinbelow, the output currents of isolated-series connected transformers are inherently limited by the leakage inductance described previously. However, this leakage inductance has not heretofore been considered readily controllable. Therefore, in certain applications, a current-limiting inductance has been included in the output of the isolated-series transformer. The current-limiting inductance of an isolated-series transformer may be a separate circuit component or it may be integrated into the transformer structure. One method of integrating the ballast inductor into the transformer structure is to utilize a "gapped-leg" configuration. The operation of such a "gapped-leg" transformer is described in greater detail herein with reference to FIG. 5.

Both the gapped leg and the external inductor have disadvantages. The external ballast inductor is a bulky, expensive additional element, and is especially disadvantageous when it is necessary to provide a separate inductor for each lamp. The gapped leg adds complexity and expense to the transformer manufacture while proving to be a less than ideal ballasting inductor. Therefore, it would be advantageous to provide output inductance for an isolated series connected transformer for multilamp ballast circuits which does not share the inherent disadvantages of the gapped-leg transformer or the external inductor configurations.

Recent advances in magnetics have made it possible to quantize the leakage characteristics of transformers and to rely upon leakage phenomena as a design parameter rather than a parasitic parameter of the transformer. The value of the leakage inductance can be calculated from the geometry of the transformer core and winding using equations such as those derived for several simple cases by A. Daujahre in "Modeling and Estimation of Leakage Phenomena in Magnetic Circuits", PhD. Thesis, California Institute of Technology, Pasadena, CA. 1986, which is hereby explicitly incorporated by reference.

SUMMARY OF THE INVENTION

Briefly, the invention contemplates a means for integrating all the magnetic functions required in a ballast for a fluorescent lamp in one standard magnetic core. A single core is used to provide isolation, voltage step-up, ballasting, power factor correction and cathode heat in a ballast operating multiple lamps in an "isolated-series" configuration. The isolated-series configuration uses magnetics to connect two or more loads while permitting one end of each of the loads to be grounded. The use of a single standard core helps reduce the cost of the ballast, thus making it competitive in the marketplace.

More explicitly, in one preferred embodiment of the present invention, a single three-legged transformer core is used. A primary winding is provided to drive the transformer from a power source. The primary winding is continuously wound on all three legs of the transformer. Secondary windings are included on two of the transformer legs to drive gas discharge lamps. Ballasting inductance is provided by winding the primary on the third leg of the transformer. The value of the ballasting inductance is directly related to the number of primary turns on the transformer leg which does not include secondary windings. The resulting transformer includes a fully integrated ballasting inductor whose value may be directly calculated and carefully controlled.

It is an object of the present invention to provide an isolated series ballast transformer wherein the leakage inductance may be accurately and precisely controlled.

It is a further object of the present invention to provide an isolated-series ballast inductor wherein the leakage inductance is controlled by distributing the primary windings between the primary and secondary legs of the coil.

It is a further object of the present invention to provide an isolated series ballast inductor wherein current limiting is provided by the leakage inductance of the transformer which is precisely controlled by distributing the primary windings between the primary and secondary legs of the coil.

It is a further object of the present invention to provide a ballast circuit adapted to drive one or more gas discharge lamps in an isolated-series configuration wherein a single magnetic transformer core provides isolation, voltage step-up, power factor correction, cathode heating and precisely controllable current limiting.

BRIEF DESCRIPTION OF THE DRAWINGS

The novel features of the invention are set forth with particularity in the appended claims. The invention itself, however, both as to organization and method of operation, together with further objects and advantages thereof, may best be understood by reference to the following description taken in conjunction with the accompanying drawings in which:

FIG. 2 illustrates in schematic form a parallel lamp ballast circuit employing multiple ballast inductors.

FIG. 3 illustrates in schematic form a parallel lamp ballast circuit employing a single current-limiting inductor with a current-sharing inductor.

DETAILED DESCRIPTION OF THE INVENTION

Figure 1:
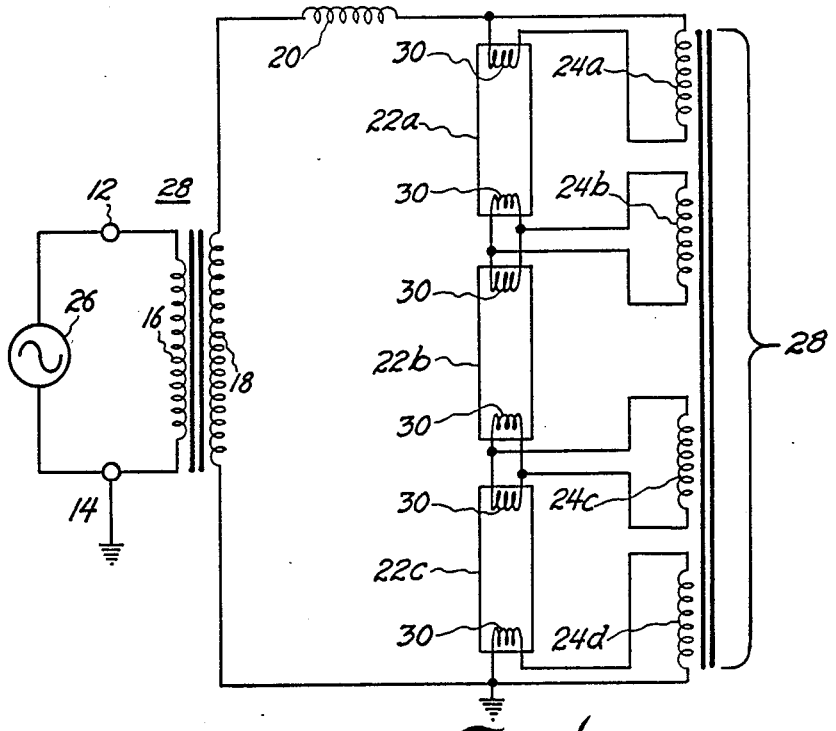
Fig. 1 (PRIOR ART)
FIG. 1 illustrates in schematic form a series-connected multi-lamp ballast circuit.

FIG. 1 illustrates in schematic form a parallel lamp ballast circuit employing multiple ballast inductors. Power supply 26 is connected to input terminals 12 and 14 to drive primary 16 of isolation transformer 28. The secondary 18 of isolation transformer 28 is connected in series with ballast inductor 20 which in turn is connected in series with fluorescent lamps 22*a*, 22*b* and 22*c*. Filament heat windings 24*a*, 24*b*, 24*c* and 24*d* are driven by isolation transformer 28 to provide current to cathode filaments 30.

In series-connected multi-lamp ballasts, such as the ballast illustrated in FIG. 1, only lamp 22*c* is grounded. The voltages required to start such a series-connected configuration are extremely high. Complex control circuits may, therefore, be required to protect against hazardous conditions resulting from these high voltages. In addition, such series-connected multilamp ballasts require additional control circuitry to achieve a power factor greater than 0.9, which is a design requirement of most lamp ballast circuits of this type. Finally, in such series-connected circuits, particularly those operated at high frequencies, leakage current may be capacitively coupled through the glass envelopes of lamps 22*a*, 22*b* and 22*c* to ground.

In order to overcome some of the drawbacks associated with series operation, the discharge lamps may be connected in parallel. FIG. 2 illustrates one form of gas discharge lamp ballast circuit in which parallel operation is accomplished using separate current-limiting inductors. Alternating current power is received by primary winding 130 disposed on transformer core 150. Secondary winding 140, disposed on core 150 and therefore magnetically coupled to primary winding 130, is connected to one side of filaments 114 and 124 in lamps 110 and 120, respectively, and is also connected to windings 153*a* and 153*b* on inductor cores 152*a* and 152*b*, respectively. A current-limiting inductor for lamp 110 comprises core 152*a* with gap 154*a* and electrically-conductive winding 153*a*. This inductor acts to limit the current in lamp 110. Similarly, lamp 120 is connected in series with a current-limiting inductor comprising core 152*b* with gap 154*b* and electrically-conductive winding 153*b*. Thus each lamp is connected to a separate current-limiting impedance element. This configuration reduces leakage current but also increases the volt-ampere requirements of the ballast circuit and outweighs many of the cost and performance advantages associated with multiple lamp ballast circuits. It should also be noted that for reasons previously mentioned, lamp starting in the parallel circuit of FIG. 2 is more difficult than lamp starting in the series circuit of FIG. 1.

In order to reduce the size requirements for the inductors in a parallel circuit, one of the ballast inductors may be replaced by a smaller current-sharing inductor. As shown in FIG. 3, a single main ballast inductor 152 is used with a smaller, current-sharing inductor 170 which is designed to balance current through the two lamps. Thus, in FIG. 3, a current-limiting inductor comprising core 152 with gap 154 and windings 153 is connected in series with one side of secondary winding 140. The other end of this series-connected current-limiting inductor is connected to the central tap of a winding pair on core 170. The central tap is part of two windings, 171 and 172, which are magnetically coupled as shown. The other ends of windings 171 and 172 are connected to filaments 112 and 122, of lamps 110 and 120, respectively. Additionally, one side of lamp filaments 114 and 124 are each connected to the other side of secondary winding 140, as shown. However, this arrangement also has its drawbacks. The current-sharing coil only tolerates small lamp-to-lamp voltage differences without saturation. Also, it is difficult to extend this configuration to a ballast circuit driving more than two lamps.

Figure 4:
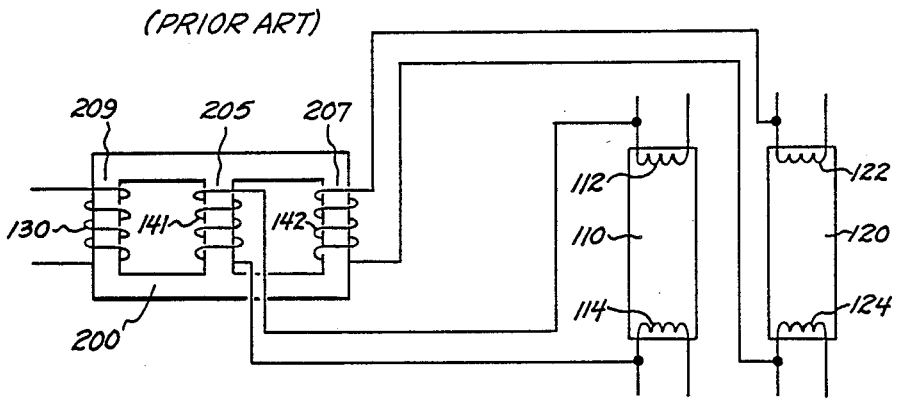
FIG. 4 illustrates in schematic form an isolated-series lamp ballast circuit driving two lamps in what is effectively a series combination.

One way of overcoming the disadvantages associated with both parallel and series operation of gas discharge lamps is to use an isolated-series configuration. FIG. 4 illustrates a transformer core 200 with legs 209, 205 and 207 having disposed thereon primary winding 130 and secondary windings 141 and 142, respectively. The ends of secondary windings 141 are connected directly to distinct sides of cathodes 112 and 114 of lamp 110. Likewise, the ends of secondary windings 142 are connected directly to distinct sides of cathodes 122 and 124 of lamp 120. Thus, in this sense, lamps 110 and 120 are connected directly across secondary windings 141 and 142, respectively.

The ballast circuit of FIG. 4 is designed to operate the lamps electrically in series, but at the same time allow each lamp to operate from an isolated winding—thus the designation "isolated-series". The magnitude of the magnetic flux in primary leg 209 is equal to the sum of the magnetic fluxes in secondary legs 205 and 207. Since the voltage per turn developed on any winding is proportional to the time derivative of the flux passing through the winding, it can be seen that the primary voltage per turn is proportional to the sum of the two secondary voltages per turn. Therefore, since the lamp loads are effectively connected in series to individual, isolated windings, the highest potential appearing on the secondary side is the voltage drop across a single lamp. This thereby reduces any leakage current occurring in series-connected multiple lamp installations. By observing proper phase relationships, it is also possible to connect one end of the lamps together to a common point, if desired, without increasing possible voltage drops. The flux in each secondary leg of the transformer is opposed by a counter flux when current flows through the secondary coil. When one lamp turns on and its resistance begins to decrease, the net flux in that secondary leg decreases and the secondary voltage also decreases, limiting the output current. In addition, once one lamp turns on, reducing the net flux in the secondary leg driving that lamp, the flux in the other secondary leg increases, increasing the voltage across the second lamp. Thus not only does the isolated-series configuration result in lower output voltages, as in the parallel configuration, but it also shares the start-up advantages of the series configuration.

Even though the output current of isolated-series configured transformers is limited, however, the output inductance may not be suitable for use with certain discharge lamps. In order to obtain a suitable output inductance without resorting to separate output inductors, the leakage inductance of the transformer might be used if a suitable arrangement could be found whereby the leakage inductance could be quantified and controlled. Any transformer has a certain amount of leakage inductance associated with it. This leakage inductance represents flux from the primary winding that does not link the turns of the secondary winding. Because of the difficulties involved in quantizing and controlling leakage, transformer designers have traditionally tried to minimize the leakage inductance. Thus transformers are normally wound in such a way that the primary and secondary windings occupy, as far as possible, the same space. In practice, this means putting both of the windings on the same leg of the transformer.

As discussed previously, lamp ballasts typically require two principal magnetic components—an isolation transformer to step-up the voltage, and a ballast inductor to act as the ballasting element. The ballasting inductor is the element that limits current to the lamp and hence is typically situated in series with the secondary.

In practice, a great deal of effort goes into building low leakage transformers which are used in ballasting circuits with large external inductors. The principal reason for designing ballast circuits in this manner has been that the leakage inductance of a transformer is difficult to characterize or quantize. Therefore, leakage inductance could not be relied upon as a design parameter. However, advances in modelling and analysis of leakage phenomena make it possible to design ballast circuits using the transformer leakage inductance as a design parameter. It is therefore, desirable to integrate the external current-limiting inductor into the ballast transformer by making use of the transformer leakage inductance.

Figure 5:
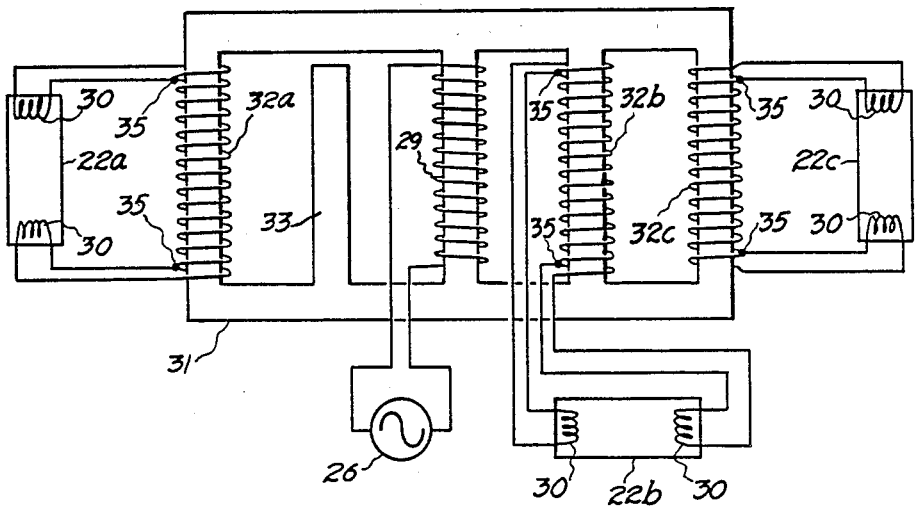
FIG. 5 illustrates in schematic form an isolated-series multi-lamp ballast including a gapped leg ballast inductor.

Integration of the current-limiting inductance into the transformer is accomplished in the transformer illustrated in FIG. 5 by providing isolation transformer 31 with a "gapped leg" 33. Power supply 26 drives primary winding 29 of isolation transformer 31. Secondary windings **32*a*, 32*b* and 32*c* are wound on secondary legs of transformer 28 and drive lamps 22*a*, 22*b* and 22*c*, respectively. Current from secondary winding taps 35 heats cathode filaments 30. Gapped leg 33 serves as a current-limiting ballast inductor to limit the current supplied to lamps 22*a*, 22*b* and 22*c***.

Gapped leg 33 limits the secondary current by providing an alternative path for the secondary flux. Normally the secondary flux would not readily pass through the gapped leg since the gap acts as a substantial reluctance and there are alternative, low reluctance paths through the transformer secondary. However, once lamps **22*a*, 22*b* and 22*c* turn on and current begins to flow, the lamp resistance begins to decrease, increasing the secondary current necessary to maintain a constant secondary output voltage. This increased secondary current causes a counter magnetic flux to build up in the transformer core leg on which the secondary winding is disposed, thus reducing the net flux in the leg by increasing the reluctance of the secondary path. Since the reluctance of the secondary path is increased, there is a decrease in the net flux in the secondary path and an increase in the net flux through gapped leg 33**. The lower net flux in the secondary leg results in a lower voltage across the secondary winding, thus limiting current to the lamp. In other words, the gapped leg performs substantially the same function as an external current-limiting ballast inductor. However, the gapped leg is not an ideal solution to the problem of integrating the current-limiting inductance, as will be discussed more fully hereinafter.

Figure 6:
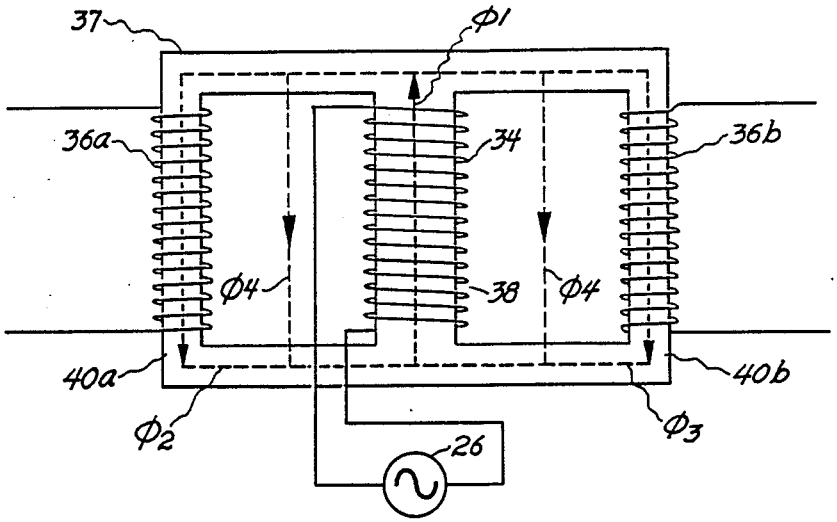
FIG. 6 illustrates in schematic form the flux paths in a transformer connected in isolated series.
Figure 7:
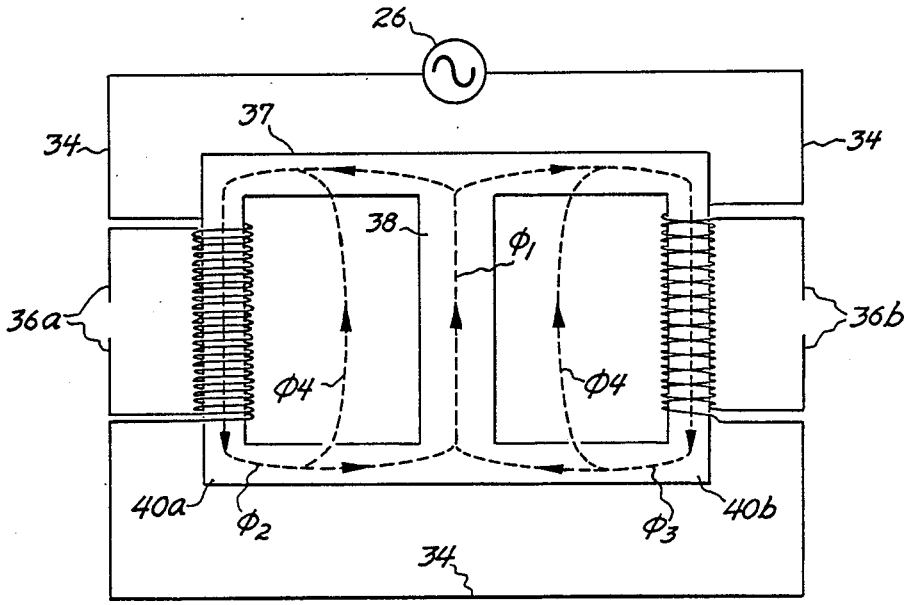
FIG. 7 illustrates in schematic form a transformer connected in isolated series wherein the primary has been modified to increase the primary to secondary coupling.

As an alternative to the gapped-leg transformer, the present invention concerns a method of winding an isolated-series transformer to advantageously employ the leakage inductance to provide current limiting. FIGS. 6 and 7 illustrate the degree to which leakage flux (i.e., primary flux not linking with the secondary windings) may be controlled by properly winding the transformer. As shown in FIG. 6, power supply 26 drives primary winding 34 of isolation transformer 37. $\phi_1$ represents the flux developed in center leg 38 of transformer 37. This flux is divided between secondary legs **40*a* and 40*b* to drive secondary coils 36*a* and 36*b* respectively. The flux in secondary leg 40*a* is labeled $\phi_2$ and the flux in secondary leg 40*b* is labeled $\phi_3$. However, not all of the flux generated by the primary winding is conducted through secondary legs 40*a* and 40*b*. The portion of flux $\phi_1$ not conducted by secondary legs 40*a* and 40*b*** is the leakage flux which is schematically illustrated as $\phi_4$.

It is apparent from FIGS. 6 and 7 that a physical transformer could be modeled as including an extra, high reluctance leg which conducts the leakage flux. In transformers which do not include gapped legs, such as in FIG. 4, the reluctance of this "leakage leg" is a complex function of the transformer geometry. Introduction of a gapped leg provides the leakage flux with a relatively low reluctance path. In a transformer which includes a gapped leg (FIG. 5), the reluctance of the leakage flux path is approximately the reluctance of the gapped leg. Therefore, the longer the gapped leg, the lower the reluctance of the leakage leg.

As was explained with reference to FIGS. 4 and 5, when current flows in the secondary legs a counter flux in the secondary legs reduces the net flux in those legs, increasing the leakage flux. Since the counter flux is directly proportional to the current developed in the secondary winding, anything which aids development of a counter flux acts to limit the output current. By analogy, the leakage flux path acts as an inductor, limiting the current output of the transformer. Any decrease in the reluctance of the leakage flux path results in an increase in the output inductance.

In gapped-leg transformers, the gapped leg acts as the leakage flux path. The longer the gapped leg (i.e., the shorter the gap), the lower the leakage flux path reluctance. The gapped leg acts to increase the leakage inductance and limit the output current by aiding in the development of counter flux in the transformer secondary. Therefore the value of the leakage inductance provided by the gapped leg in the transformer of FIG. 5 is inversely proportional to the reluctance of the leg. Since the leakage inductance of the leg increases as the air gap gets smaller, the leakage inductance is maximized when the air gap disappears. Conversely, the value of the leakage inductance decreases as the air gap grows. Thus the leakage inductance in the transformer of FIG. 6 is substantially lower than the leakage inductance of the gapped-leg transformer of FIG. 5 since the air gap in FIG. 6 extends across the entire transformer. To minimize the leakage inductance further, it is necessary to increase the coupling between the primary and secondary. One example of such a transformer is the previously described transformer in which the primary and secondary windings are both wound on the same leg.

FIG. 7 illustrates an alternative method of tightly coupling the primary and secondary which is suitable to isolated-series operation. The primary winding of transformer 37 is wound on secondary legs 40*a* and 40*b* in a continuous manner to insure that substantially all the flux developed by primary winding 34 is linked to secondary windings 36*a* and 36*b*. Thus in transformer 37 the leakage flux does not limit the voltage developed in the secondary windings and the leakage inductance is reduced to substantially zero, increasing the external inductance necessary to limit the output current.

The transformers of FIGS. 5, 6 and 7 are wound in "isolated-series", that is, each of the secondary output windings occupies a separate transformer leg. The isolated-series configuration is attractive because it combines the advantages of parallel operation with the operational advantages of series operation. The advantage of both the isolated-series and the parallel configurations is that no lamp is floating with respect to ground. Therefore, when a lamp is removed from its socket, the voltage between the open terminal and ground is no more than one lamp voltage. The operational advantage of the isolated-series configuration results from each of the lamps being driven from a separate secondary coil, eliminating the aforementioned difficulties normally encountered when starting gas discharge lamps arranged in parallel. However, if the transformers are wound as illustrated in FIGS. 5 and 6, the leakage flux that does not link the primary winding and secondary windings reduces the secondary current to the lamps and may result in reduced output from the lamps. Therefore, this is not a preferred method of operating isolated-series transformers in gas discharge ballast circuits.

The isolated-series configuration illustrated in FIGS. 6 and 7 provides advantages not previously obtainable in series or parallel connected systems. It is well known that the leakage flux inherent in the isolated-series configuration of FIGS. 6 and 7 may be advantageously employed to limit the output current by including a "gapped leg" as in FIG. 5. However, the leakage flux in the gapped leg may be too large for some lamp configurations. In addition the use of a gapped leg increases the complexity and expense of designing and manufacturing such transformers. The complexity of designing and manufacturing transformers employing leakage flux as a design parameter results from difficulty in predicting the effect on leakage of even minor variations in the transformer core. Therefore, such designs are usually accomplished by expensive and time consuming trial and error methods, and the resulting design requires strict manufacturing tolerances. Moreover, since the addition of a gapped leg can only increase the leakage inductance, it is not possible to reduce the leakage inductance of a given transformer configuration beyond a fixed value. Due to these considerations, most designers feel that the advantages to be obtained by using the leakage inductance as a design parameter are outweighed by the design and manufacturing difficulties.

In the present invention the leakage inductance of an isolated-series transformer is utilized in a quantifiable and controllable manner to provide output inductance to the isolated-series transformer outputs. From FIGS. 6 and 7, it is clear that the leakage inductance is, to a large extent, controllable. If the transformer is wound using a combination of the two configurations described above with reference to FIGS. 6 and 7, then any value of leakage inductance can be obtained by proper division or distribution of the number of primary turns per leg.

Figure 8:
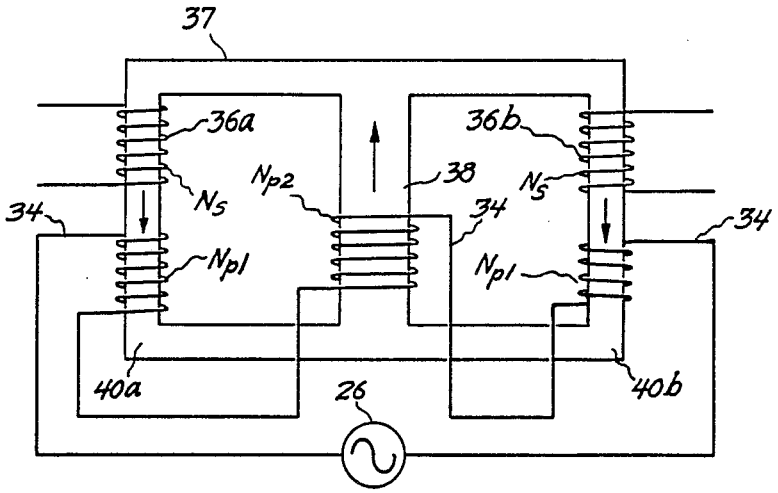
FIG. 8 illustrates in schematic form a controlled leakage transformer according to the present invention.

FIG. 8 illustrates a preferred embodiment of the present invention in which primary winding 34 is distributed on secondary legs 40*a* and 40*b* as well as on center leg 38 of transformer core 37. Secondary windings 36*a* and 36*b* are disposed on secondary legs 40*a* and 40*b* respectively. $N_{p1}$ represents the number of primary turns on each of secondary legs 40*a* and 40*b*. $N_{p2}$ represents the number of primary turns on center leg 38. $N_s$ represents the number of secondary turns on secondary legs 40*a* and 40*b* respectively.

As will be recognized by those skilled in the art, the number of primary turns $N_{p2}$ on center leg 38 required to implement a particular leakage inductance is a complex function of several factors, including: the dimensions of the core, the materials used for the core, and the environment in which the transformer operates (e.g., air or oil). However, for a particular core and operating environment, the number of primary turns required to achieve a desired inductance may be calculated in a manner to be described. In most instances, such parameters as the size and construction of the transformer, along with the operating environment and electrical characteristics of the lamps, are dictated by criteria which restrict the designer's ability to modify these variables. Therefore, it may be assumed for our purposes that these variables are fixed.

In determining the specific windings for the transformer illustrated in FIG. 8 to obtain a desired leakage inductance where the variables discussed above are assumed to be fixed, the required ballast inductance is calculated from the impedance characteristics of the lamp(s) to be driven. The transformer turns ratio is calculated from the voltage requirements of the lamp(s) and the available source voltage. From a knowledge of the transformer turns ratio and the required ballast inductance, the number of turns on center leg 38 may be readily calculated. As explained above, ballast inductance is typically provided by an external inductor. In the present invention, however, need for an external ballast inductor is eliminated by using the transformer leakage inductance as reflected to the secondary output. The primary leakage inductance necessary to reflect the correct inductance to the secondary output is calculated from the transformer turns ratio. Assuming the required turns ratio is 1/N where N, an effective turns ratio, is the ratio of secondary turns of either winding to the effective number of primary turns ($N_{p1}+N_{p2}/N_c$), where $N_c$ is a constant of the transformer core equal to the number of secondary legs on the transformer, and L2 is the desired ballast inductance, the required primary inductance L1 is approximately equal to $L2/N^2$. Once the required primary inductance L1 has been calculated, the primary turns $N_{p2}$ necessary to implement the required leakage inductance may be calculated since L1 is proportional to $N_{p2}^2$. Note that primary turns $N_{p1}$ on transformer secondary legs 40*a* and 40*b* contribute almost nothing to the leakage inductance since they are coupled directly to the secondary windings and their contribution may therefore be ignored.

The total number of primary turns $N_p$ necessary to avoid saturation of the transformer for a specific input voltage and core material is calculated in a known manner. Knowing the number of primary turns $N_p$ required to avoid saturation of the transformer and the number of primary turns $N_{p2}$ on transformer leg 38 necessary to reflect the required leakage inductance to the transformer output, it is possible to determine the number of primary turn $N_{p1}$ to be disposed on each of the secondary legs from the following equation:

$$N_c N_{p1} = N_p - N_{p2}.$$

Figure 9:
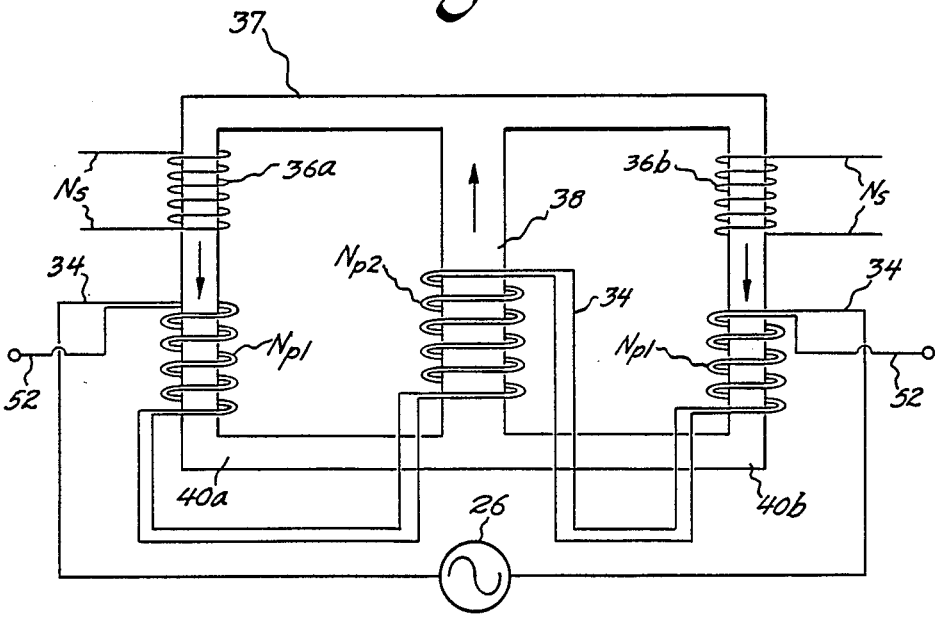
FIG. 9 illustrates in schematic form a preferred embodiment of the present invention including a power factor correction winding.

As is well known to those skilled in the art, electronic ballasts are required to have a power factor that is greater than 0.9. In order to achieve this power factor, it is possible to add an extra winding to the transformer core of FIG. 8 that will act as a power factor correction winding. Such a winding may be implemented by adding a winding which overlays the primary winding on all three legs of the transformer. This is illustrated by power factor correction winding 52 which overlays primary windings $N_{p1}$ and $N_{p2}$ in FIG. 9.

Figure 10:
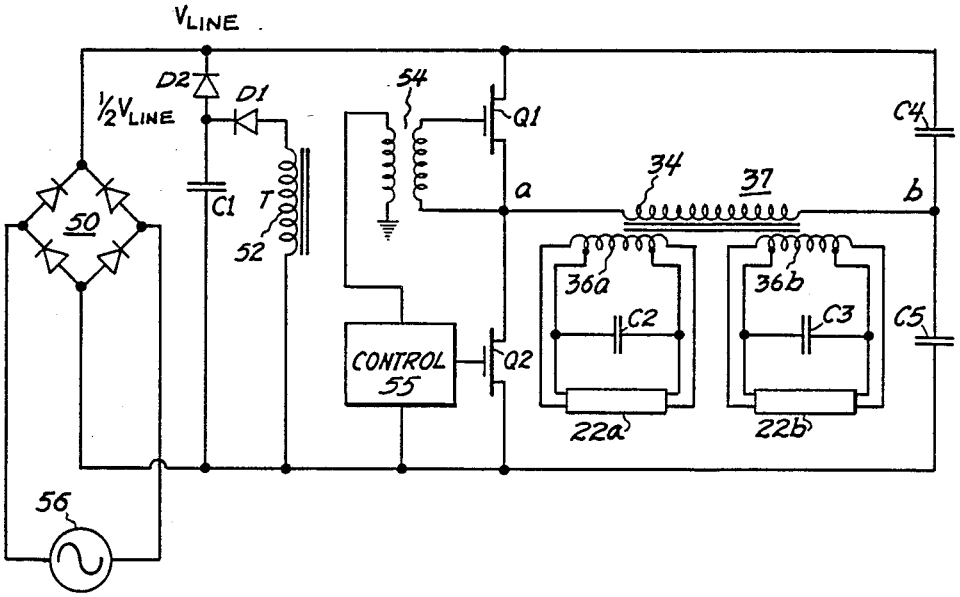
FIG. 10 illustrates in schematic form a complete ballast circuit including the controlled leakage transformer with integral ballasting inductor of the present invention.

FIG. 10 illustrates a ballast circuit for driving two 34 watt fluorescent lamps 22*a* and 22*b*. AC power supply 56 drives a conventional full wave rectifying bridge 50 which is connected across series-connected diode D2 and capacitor C1. Power factor correction winding 52 charges capacitor C1 through diode D1 to half the value of rectified line voltage $V_{line}$. Diode D2 is therefore back biased as long as the rectified line voltage is greater than the voltage across C1. When the AC line voltage goes below the rectified line voltage, charge from capacitor C1 supplies the power circuit through diode D2. This arrangement effectively increases the conduction angle of the bridge rectifier diodes to 120 degrees. This in turn raises the power factor of the system to above 0.9. This power factor correction method has been described by J. J. Spangles in "A Power Factor Correction MOSFET, Multiple Output Switching Supply", Proceedings of the 10th International PCI, Chicago, Ill. 1985, pp 19–32 which is hereby specifically incorporated by reference.

In the circuit of FIG. 10, control 55 drives converting field effect transistors Q1 and Q2, connected in a half bridge configuration, at a first, start-up frequency until the lamps ignite, and at a second, operating frequency thereafter. Control 55 may be implemented by any number of circuits well known in the art for controlling half bridge resonant circuits. One possible embodiment of control 55 is illustrated in commonly assigned U.S. Pat. No. 4,672,528 of Park et al., which is hereby incorporated herein by reference. Although the circuit described in that patent is designed to control a full bridge, it may be suitably modified to control the half bridge circuit of FIG. 10. Transistors Q1 and Q2 convert the rectified DC ($V_{line}$) to an AC voltage at a frequency determined by control 55. Isolation transformer 54 enables control 55 to drive both legs of the converter since transistor Q1 is floating with respect to the control ground. Capacitors C4 and C5 are the converter half bridge capacitors for transistors Q1 and Q2 respectively. Primary winding 34 of isolation transformer 37 (similar in configuration to the transformer of FIG. 5) is connected between nodes a and b of the DC to AC converter. Primary winding 34 drives secondary windings 36*a* and 36*b* in an isolated series configuration. Capacitors C2 and C3 are selected to maximize the voltage across lamps 22*a* and 22*b*, respectively, at the first, start up frequency.

Figure 11:
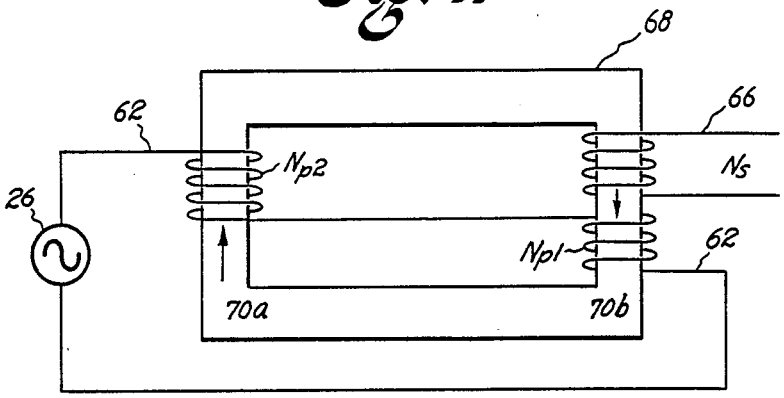
FIG. 11 illustrates in schematic form a two-legged isolation transformer according to the present invention.

Another embodiment of the present invention is illustrated in FIG. 11. Transformer 68 includes primary winding 62 which is driven by AC source 26. Primary 62 includes windings $N_{p1}$ and $N_{p2}$ on transformer legs 70*b* and 70*a* respectively. Only winding $N_{p2}$ contributes to the leakage inductance since turns $N_{p1}$ are coupled tightly to secondary coil 66.

Figure 12:
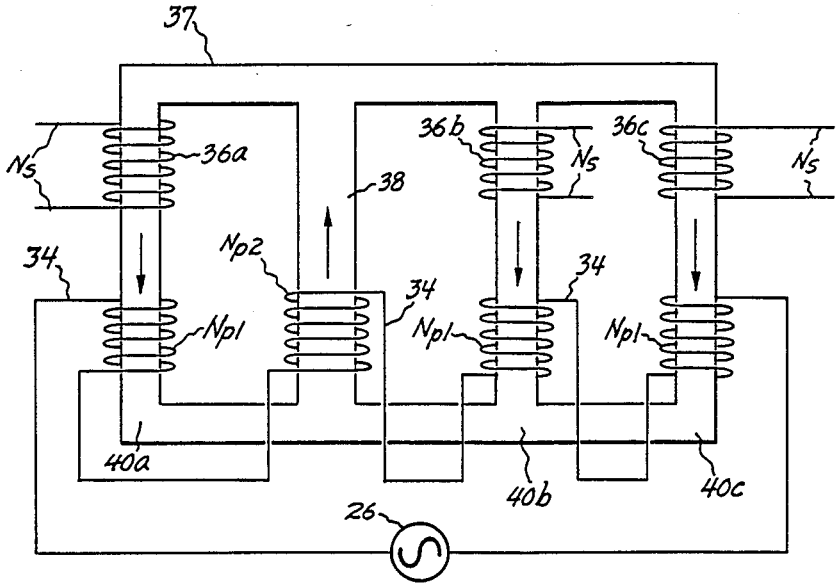
FIG. 12 illustrates in schematic form a four-legged transformer used to drive three lamps, according to the present invention.
Figure 13:
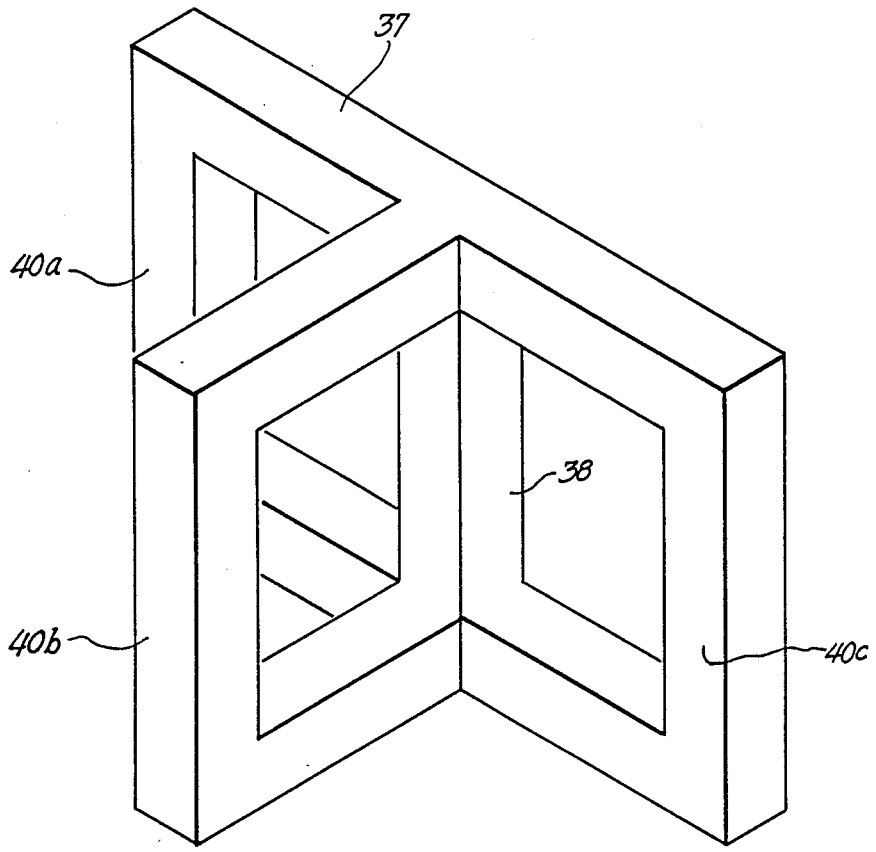
FIG. 13 illustrates in perspective view a four-legged transformer core which might be used in the present invention to drive three lamps.

FIG. 12 illustrates schematically an embodiment of the transformer of FIG. 8, wherein a third secondary leg 40*c* has been added to the transformer. A third lamp may be driven by third secondary winding 36*c* on leg 40*c*. FIG. 13 illustrates one possible embodiment of a transformer core which could be used to construct the transformer of FIG. 12.

It will be appreciated that nothing in the present invention is intended to limit the number of lamps which may be connected to the transformer secondary coils either in series or parallel. Although the preferred embodiment, as illustrated in FIG. 5, would normally have only one lamp connected to each secondary, since this arrangement is advantageous from a safety standpoint, it may be desirable in certain circumstances to connect several lamps, either in series or parallel, across any of secondary windings 32*a*, 32*b* and 32*c*.

While preferred embodiments of the present invention have been shown and described herein, it will be obvious to those skilled in the art that such embodiments are provided by way of example only. Numerous variations, changes, and substitutions will now occur to those skilled in the art without departing from the invention. Accordingly, it is intended that the invention be limited only by the spirit and scope of the appended claims.

What is claimed is:

1. An isolation transformer for use in a multi-lamp ballast comprising:

a multi-legged transformer core having at least three legs, an electrical primary winding and multiple electrical secondary windings;

at least one of said legs constituting a leakage leg of said transformer and the remaining ones of said legs, being $N_c$ in number, constituting secondary legs;

said electrical primary winding distributed on each leg of said core in a continuous manner and containing a number of turns $N_p$ necessary to avoid saturation of the transformer for any specific input voltage and core material, the number of primary turns $N_{p1}$ disposed on each of said secondary legs and the number of primary turns $N_{p2}$ disposed on said leakage leg being determined according to the equation $N_cN_{p1}=N_p-N_{p2}$; and said electrical secondary windings disposed on said secondary legs.

2. The isolation transformer of claim 1 further including a power factor correction winding distributed on each of said legs in a continuous manner.

3. The isolation transformer of claim 1 wherein the portion of said primary winding disposed on said leakage leg constitutes a ballasting inductor of inductance value L2 where N is the ratio of secondary turns disposed on any of said secondary legs to the effective number of primary turns $N_{p1}+N_{p2}/N_c$, and inductance L1 of said primary winding is approximately equal to $L2/N^2$.

4. An isolation transformer for use in a multi-lamp ballast comprising:

a two-legged transformer core, a primary winding and a secondary winding;

a first of said transformer core legs constituting a primary leg;

a second of said transformer core legs constituting a secondary leg;

said primary winding being distributed on both said first and said second core legs in a continuous manner and containing a number of turns $N_p$ necessary to avoid saturation of the transformer for any specific input voltage and core material, the number of primary turns $N_{p1}$ disposed on said secondary leg and the number of primary turns $N_{p2}$ disposed on said primary leg being determined according to the equation $N_cN_{p1}=N_p-N_{p2}$, where $N_c$ is the number of secondary legs: and said secondary winding being disposed on said secondary core leg.

5. The isolation transformer of claim 4 wherein the portion of said primary winding disposed on said secondary core leg constitutes a ballasting inductor of inductance value L2 wherein N is the ratio of secondary turns disposed on said secondary core leg to the effective number of primary turns as expressed by $N_{p1}+N_{p2}/N_c$, and inductance L1 of said primary winding is approximately equal to $L2/N^2$.

6. The isolation transformer of claim 4 further including:

a power factor correction winding distributed continuously on said primary and said secondary legs.

7. A method of manufacturing an isolation transformer for use in a multi-lamp ballast including a multi-legged transformer core, a primary winding and a secondary winding, comprising the steps of:

distributing said primary winding on each of said legs of said transformer in a continuous manner and so as to contain a number of turns $N_p$ necessary to avoid saturation of the transformer for any specific input voltage and core material, the number of primary turns $N_{p1}$ disposed on all but one of said legs of said transformer in a continuous manner and the number of primary turns $N_{p2}$ disposed on said one of said legs of said transformer being determined according to the equation $N_cN_{p1}=N_p-N_{p2}$, where $N_c$ is the number of legs on which said secondary winding is disposed; and disposing said secondary windings on all but said one of said legs of said transformer.

8. A method of manufacturing an isolation transformer for use in a multi-lamp ballast including a two-legged transformer core, a primary winding and a secondary winding, comprising the steps of:

winding a primary coil on each of said legs of said transformer and so as to comprise a total number of turns $N_p$ necessary to avoid saturation of the transformer for any specific input voltage and core material, the number of primary windings $N_{p1}$ being wound on one of said legs of said transformer and the number of primary windings $N_{p2}$ being wound on the other of said legs of said transformer being determined according to the equation $N_cN_{p1}=N_p-N_{p2}$, where $N_c$ is the number of legs wound with secondary turns; and winding a secondary coil on either one of said legs of said transformer.

* * * * *